US008118637B2

(12) United States Patent
De La Torre

(10) Patent No.: US 8,118,637 B2
(45) Date of Patent: Feb. 21, 2012

(54) TOY

(75) Inventor: Gabriel De La Torre, Bell Gardens, CA (US)

(73) Assignee: Mattel Inc., El Segundo, CA (US)

( * ) Notice: Subject to any disclaimer, the term of this patent is extended or adjusted under 35 U.S.C. 154(b) by 200 days.

(21) Appl. No.: 12/542,446

(22) Filed: Aug. 17, 2009

(65) Prior Publication Data

US 2010/0041310 A1 Feb. 18, 2010

Related U.S. Application Data

(60) Provisional application No. 61/189,301, filed on Aug. 17, 2008.

(51) Int. Cl.
*A63H 33/30* (2006.01)

(52) U.S. Cl. ..... 446/473

(58) Field of Classification Search ..... 446/473, 446/475, 483; 124/16, 31, 56, 84; 74/640, 74/412 R See application file for complete search history.

(56) References Cited

U.S. PATENT DOCUMENTS

| | | | | |
|---|---|---|---|---|
| 5,711,285 | A * | 1/1998 | Stewart et al. | 124/67 |
| 5,797,385 | A * | 8/1998 | Thai | 124/66 |
| 6,280,277 | B1 * | 8/2001 | Greenberg et al. | 446/161 |
| 6,523,535 | B2 | 2/2003 | Rehkemper et al. | |
| 7,032,837 | B2 | 4/2006 | Eddins et al. | |
| 7,094,186 | B2 * | 8/2006 | Diakonov et al. | 482/104 |
| 7,731,061 | B1 * | 6/2010 | Woodhouse et al. | 222/175 |
| 2002/0016127 | A1 * | 2/2002 | Skinner et al. | 446/176 |

FOREIGN PATENT DOCUMENTS

| | | | |
|---|---|---|---|
| JP | 9299621 | A | 11/1997 |
| JP | 3047609 | U9 | 1/1998 |

OTHER PUBLICATIONS

International Search Report dated Mar. 4, 2010 for PCT/US2009/054048, International Filing Date Aug. 17, 2009.
Written Opinion dated Mar. 4, 2010 for PCT/US2009/054048, International Filing Date Aug. 17, 2009.
Pictures of Speedloader Double Cross 3000 product.
Instructions for Speedloader Double Cross 3000 product copyright 1998.

* cited by examiner

*Primary Examiner* — Gene Kim
*Assistant Examiner* — Alyssa Hylinski
(74) *Attorney, Agent, or Firm* — Cantor Colburn LLP

(57) ABSTRACT

A toy that is capable of moving between a first orientation and a second orientation and includes a housing having a first end portion with a first handle and a second end portion with a second handle, at least one of the first and second handles is rotatable within a respective handle opening defined by the housing. To move the toy from the first orientation to the second orientation, the at least one of the first and second handles is rotated by a user within its handle opening, such that the housing is rotated between its first orientation and second orientation.

23 Claims, 6 Drawing Sheets

TOY

CROSS REFERENCE TO RELATED APPLICATIONS

This application claims the benefit of the following U.S. Provisional Patent Application Ser. No. 61/189,301 filed Aug. 17, 2008 the contents of which is incorporated herein by reference thereto.

BACKGROUND

Embodiments according to the present invention are related to a toy, and more particularly to a toy for launching objects.

Toys for launching objects are popular with children, and keep them whether during solo play or play with others. However, many such toys are similar in that an object is loaded into the toy, and whether by actuating a trigger or some other actuation, the object is released or otherwise projected from the toy.

Accordingly, it is desirable to provide a toy for launching objects that also provides additional entertainment and stimulation to the user.

SUMMARY OF THE INVENTION

In one embodiment, a toy capable of moving between a first orientation and a second orientation includes a housing having a first end portion with a first handle, and a second end portion with a second handle. At least one of the first and second handles is rotatable within a respective handle opening defined by the housing. To move the toy from the first orientation to the second orientation, the at least one of the first and second handles is rotated by a user within its handle opening, such that the housing is rotated between its first orientation and second orientation. The toy may be rotatable approximately 180 degrees between its first orientation and second orientation. The first handle may include a first trigger member for actuating a first object launcher, just as the second handle may include a second trigger member for actuation a second object launcher.

In another embodiment, a toy is capable of launching a first object and a second object and further capable of moving between a first orientation and a second orientation. The toy includes a housing having a first end portion with a first handle adapted to be grasped a user's first hand and a second end portion with a second handle adapted to be grasped by a user's second hand. Each of the first and second handles are rotatable within a respective handle opening defined by the housing. To move the toy from the first orientation to the second orientation, the user rotates the handles within their handle openings such that the housing is rotated between its first orientation and second orientation relative to the handles, while the handles maintain a similar orientation in both the first and second orientations.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The invention, in accordance with preferred and various embodiments, together with further objects and advantages thereof, is more particularly described in the following detailed description taken in conjunction with the accompanying drawings in which.

Figure 1:
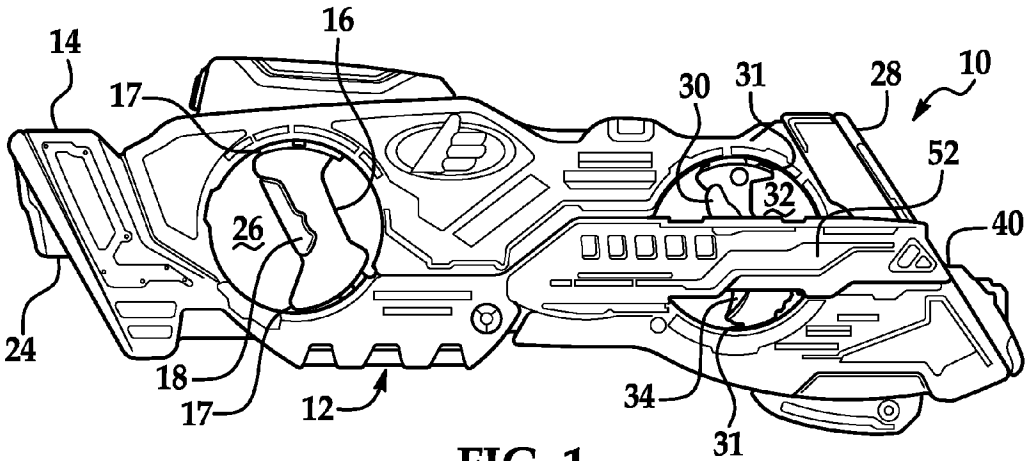
FIG. 1 is a side elevational view of the toy according to the present invention.

The detailed description explains various embodiments of the present invention, together with advantages and features, by way of example with reference to the drawings.

DETAILED DESCRIPTION OF THE INVENTION

Referring now to the Figures, a toy 10 constructed in accordance with one non-limiting embodiment is illustrated. As will be discussed herein, the toy has various embodiments or combinations wherein embodiments according to the present invention can be implemented.

As shown in FIGS. 1, 2 and 3*a*-3*b*, toy 10 includes housing 12 having a first end portion 14 with an associated movable first handle 16. The first handle 16 includes a first activation member, shown as trigger 18, for actuating a launching mechanism for launching at least one first projectile 20 from an opening 22 in an outer surface 24 of first end 14. First handle 16 is rotatably movable within first handle opening 26 of first end 14 of housing. In one embodiment, the housing 12 further includes a second end portion 28 with an associated movable second handle 30 and a second trigger 34 for launching at least one second projectile 36 from an opening 38 in the outer surface 40 of second end 28. Second handle 30 is rotatably movable within second handle opening 32 of second end portion 28.

Figure 2:
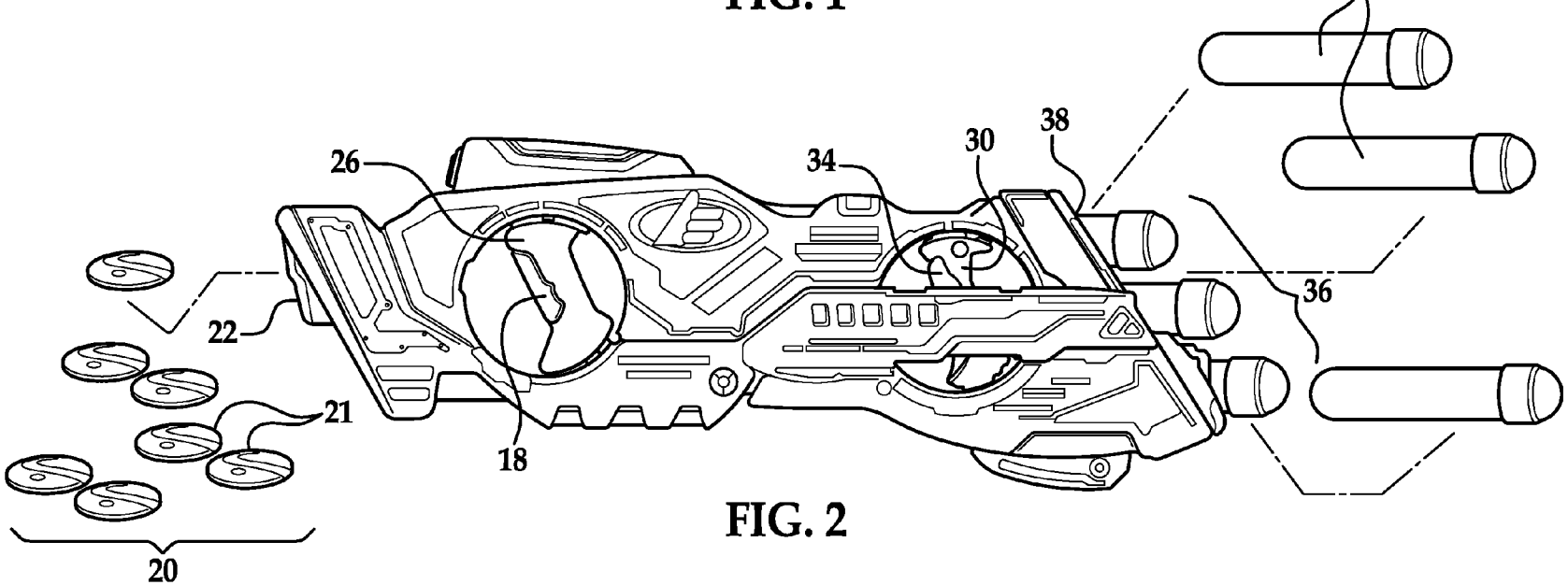
FIG. 2 is a side elevational view of the toy of FIG. 1, with the launching objects shown.

First and second projectiles 20, 36 may be of different type and size, for example, as shown in FIG. 2, first projectile 20 is shown as a generally flat disc-shaped object 21, while second projectile 36 is shown as an elongated projectile, for example a dart 37, which may be formed or foam or plastic or other common play material. In the alternative, first and second projectiles 20, 36 may be of the same or similar type and size, depending on the desired effect and/or play pattern of toy 10. Again, the projectiles shown are illustrative, and may take any numerous forms and shapes, including but not limited to spherical objects, cubes, etc. In the embodiment shown, the user loads the projectiles by inserting discs 21 into at least opening 22 of first end 14 via which the projectiles are launched (see FIG. 3*a*). With regard to the second end 28, darts 37 are loaded into at least one receiving chamber 38 of second end 28 of housing 12 (see FIG. 3*b*).

Figure 3A:
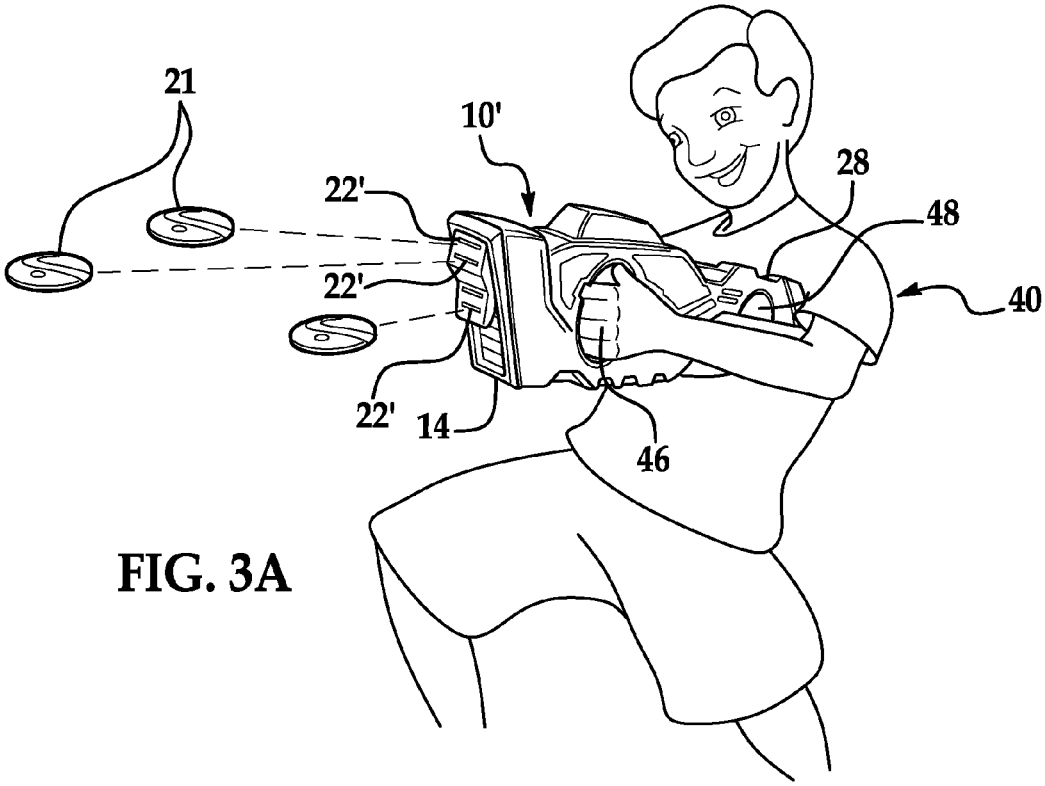
FIG. 3*a* is a perspective view of an embodiment of the toy, showing a user grasping the toy in the first orientation and showing first objects being launched from the first end.
Figure 3B:
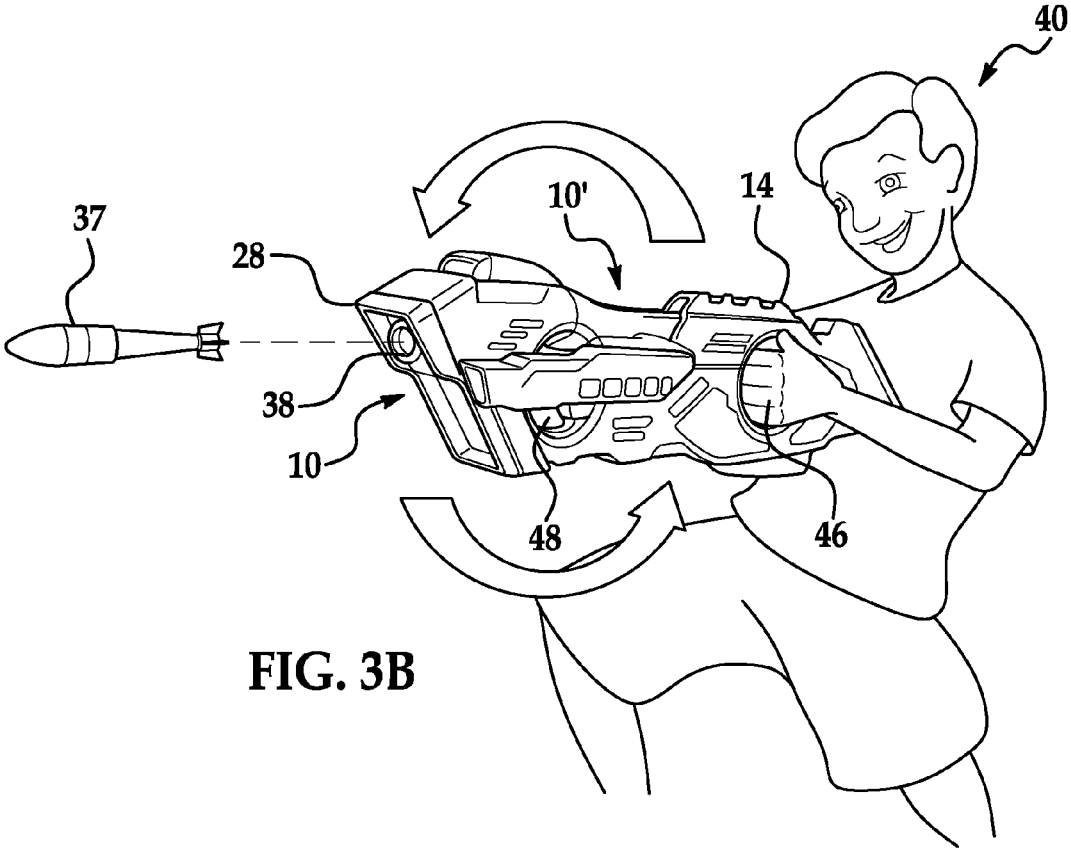
FIG. 3*b* is a perspective view of the toy of FIG. 3*a*, showing the user grasping the toy in the second orientation and showing second objects being launched from the second end.

As shown in FIGS. 3*a*-3*b*, the user 40 can hold toy 10 in one of two orientations. For purposes of illustration only, the first orientation is shown in FIGS. 1, 2 and 3*a*, while the second orientation is shown in FIG. 3*b*. Of course it is fully contemplated herein that the toy 10 is movable between the first and second orientations, and such nomenclature is exemplary. In the first orientation, the second end 28 is disposed proximate user 40, while first end 14 is distal the user. In this orientation, as shown in FIGS. 1, 2 and 3*a*, the user may actuate first trigger 18 so that projectiles 20 are launched from a first launch opening 22 of first end 14 away from the user 40. In this first orientation of toy 10, preferably the second trigger 34 is not operable, such that second projectiles 36 are not launchable in the direction of user.

FIGS. 3*a*, 3*b*, 4*a* and 4*b* illustrate the movement and transformation of toy 10 from the first orientation of FIGS. 1, 2 and 3*a* in which the first trigger 18 is actuatable and objects 20 are capable of being launched, to the second orientation of FIG. 3*b* in which the second trigger 34 is actuatable and objects 36 are capable of being launched from a second launch opening 38. As shown in FIG. 3*a* the user 40 holds first handle 16 with one hand and second handle 30 with his other hand. For the sake of illustration only, FIG. 3*a* shows first handle 16 being manipulated by the user's left hand 46, while the second handle is manipulated by the user's right hand 48. Handles 16 and 30 are rotatable within their respective handle openings 26 and 32, illustrated in this embodiment as a generally circular first handle opening 26 and a generally circular second handle opening 32, each defined within their respective portions of housing 12. The handles are rotatably or pivotally attached to housing 12, such the each end of the respective handles is mounted in a rotatable manner to the housing portion defining openings 26 and 32. Such method of attachment may include the handle having end portions 17, 31 (see FIG. 1) that move and rotate within a groove or a track of the housing portion, allowing the user to provide rotation thereto. Of course, other ways known in the art may be utilized to provide rotation to the handles.

Figure 4A:
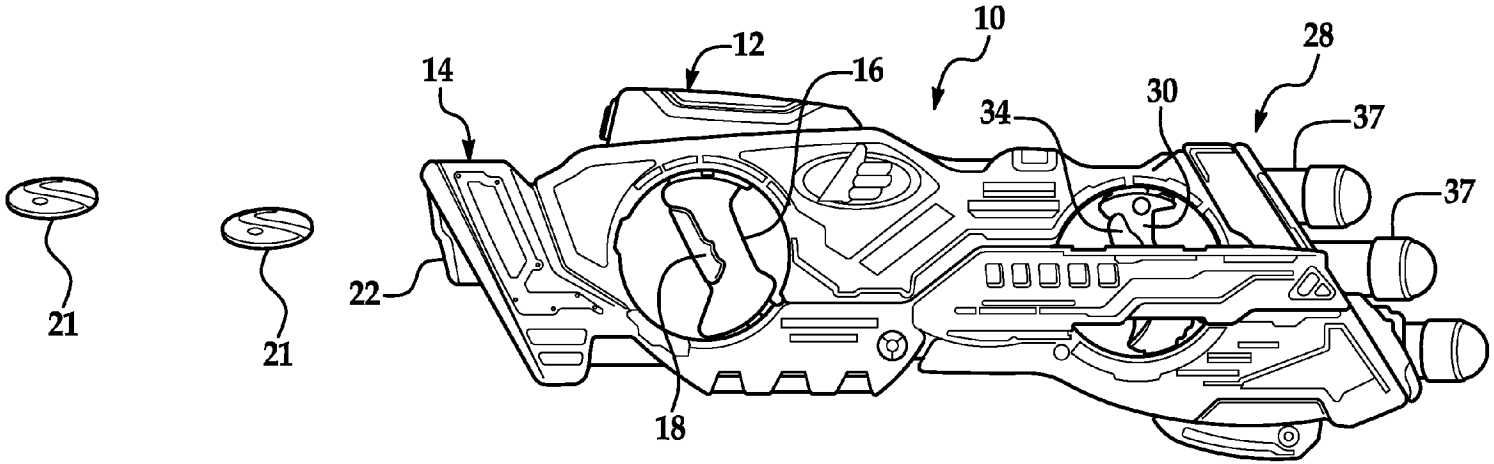
FIG. 4*a* is a side elevational view of the toy of FIG. 2 in the first orientation, showing first objects being launched therefrom.
Figure 4B:
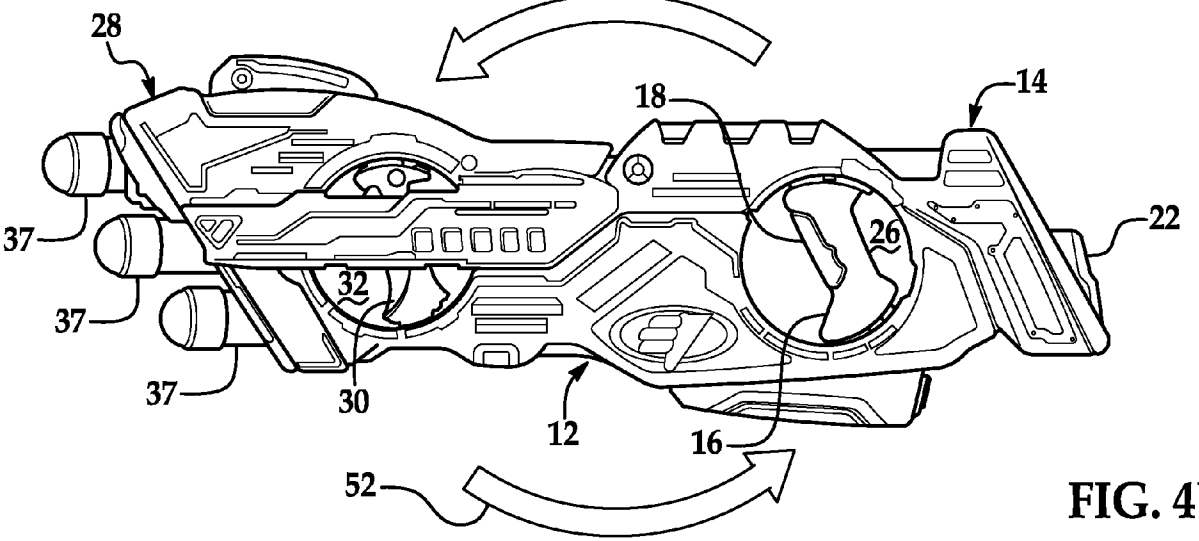
FIG. 4*b* is a side elevational view of the toy of FIG. 2 in the second orientation in accordance with an exemplary embodiment of the present invention.

As such, the user holds the respective handles as shown in FIG. 3*a* and rotates the handles within their respective handle openings in the direction as shown by arrows 50 and 52 in FIG. 4*b*. This causes the housing 12 itself to rotate approximately 180 degrees relative to the handles, resulting in achieving the second orientation of toy 10 illustrated in FIGS. 3*b* and 4*b*. In this second orientation, first end 14 is disposed proximate user 40, while the second end is distal user 40.

Note that during the transformation of toy 10 from the first orientation to the second orientation, the user's hands maintain their grip on handles 16, 30, and also the user's hands and the handles 16, 30 rotate such that they remain in generally the same position in each orientation (see FIGS. 4*a* and 4*b*). For example, compare FIGS. 4*a* (toy in first orientation) and 4*b* (toy in second orientation), wherein it is illustrated that each handle in each Figure is orientated at a similar angle with the trigger 18, 34 facing forward, despite the toy 10 having been rotated.

Thus, in the second orientation, as shown in FIGS. 3*b* and 4*b*, the second trigger 34 is actuatable such that the user may activate the second trigger 34 so that projectiles are launched from the second end away from the user 40. In this second orientation of toy 10, it is contemplated that the first trigger 18 is not operable, such that first projectiles are not capable of being launched in the direction of user.

It is fully contemplated that toy 10 may have any number of first and second launch openings, without deviating from the teachings here. For example, note that the toy 10 of FIGS. 3*a* and 3*b* is generally similar in design and operation to toy 10, except that FIG. 3*a* shows a plurality of first launch openings 22' (six are shown in FIG. 3*a*) for shooting a plurality of first objects 20, and a single second launch opening 38 for shooting second objects 36. On the other hand, FIGS. 1 and 2 show a single first launch opening 22 and a plurality of second launch openings 38. Moreover, in the event of a plurality of first launching openings, the toy 10 may be configured such that actuating the trigger may launch all first objects simultaneously, or in the alternative, each launch opening can be activated in sequence by launching a first object, then moving the toy 10 from the first to the second orientation, and back to the first orientation, such that another one of the first launch openings can be made operable. Likewise with a plurality of second launch openings. Notwithstanding the number of launcher openings, for most purposes herein, a reference to the toys of FIGS. 3*a* and 3*b* may be deemed to apply to toys 10 shown in the other Figures and vice versa.

The handles 16, 30 may freely spin within their respective openings 26, 32, or the housing 12 may include a slight detent, such that each handle may need to overcome its respective detent with a sufficient force in order to begin rotation of the handles and movement between the first and second orientations. It is also contemplated that while the toy is shown moving approximately 180 degrees between the first and second orientations, the movement may be in any range necessary to achieve the objectives herein, and consistent with the teachings herein.

According to move from the second orientation to the first orientation, the user manipulates the toy 10 in the same manner as described above. It is noted that the actuation members 18, 34, shown as triggers on their respective handles, may also be located on the housing or any other area that the user may effective actuate them.

In accordance with the teachings of the present invention, it is also contemplated that the movement of the toy between the first orientation and the second orientation may be achieved by the user 40 having one hand grasping a handle (for example, user's hand 46 grasping handle 16 of FIG. 4*a*), while the user's other hand 48 may be positioned on the housing 12 itself in a manner to provide the necessary force to housing 12 to cause the rotate the handle within its opening. Thus in this embodiment, both handles would not need to rotate within their respective openings.

It is fully contemplated that the toy 10 may be manipulated by the user by grasping either handle with either hand as disclose here. However, in one embodiment, the toy 10 may include a portion attached to the housing, such as member 62 of FIG. 1, which covers a portion of second handle opening 32 on one side of housing 12, such that the user must grasp that handle from the opposite side of housing 12. Thus, depending on the placement of such member, the toy may be implemented for a right-handed user or left-handed user.

Accordingly, the toy 10 herein is capable of providing a fun and stimulating type of launching toy experience for the user, by allowing the user to manipulate the toy, and also allowing the user to launch various types of objects from both ends of the toy.

Figure 5A:
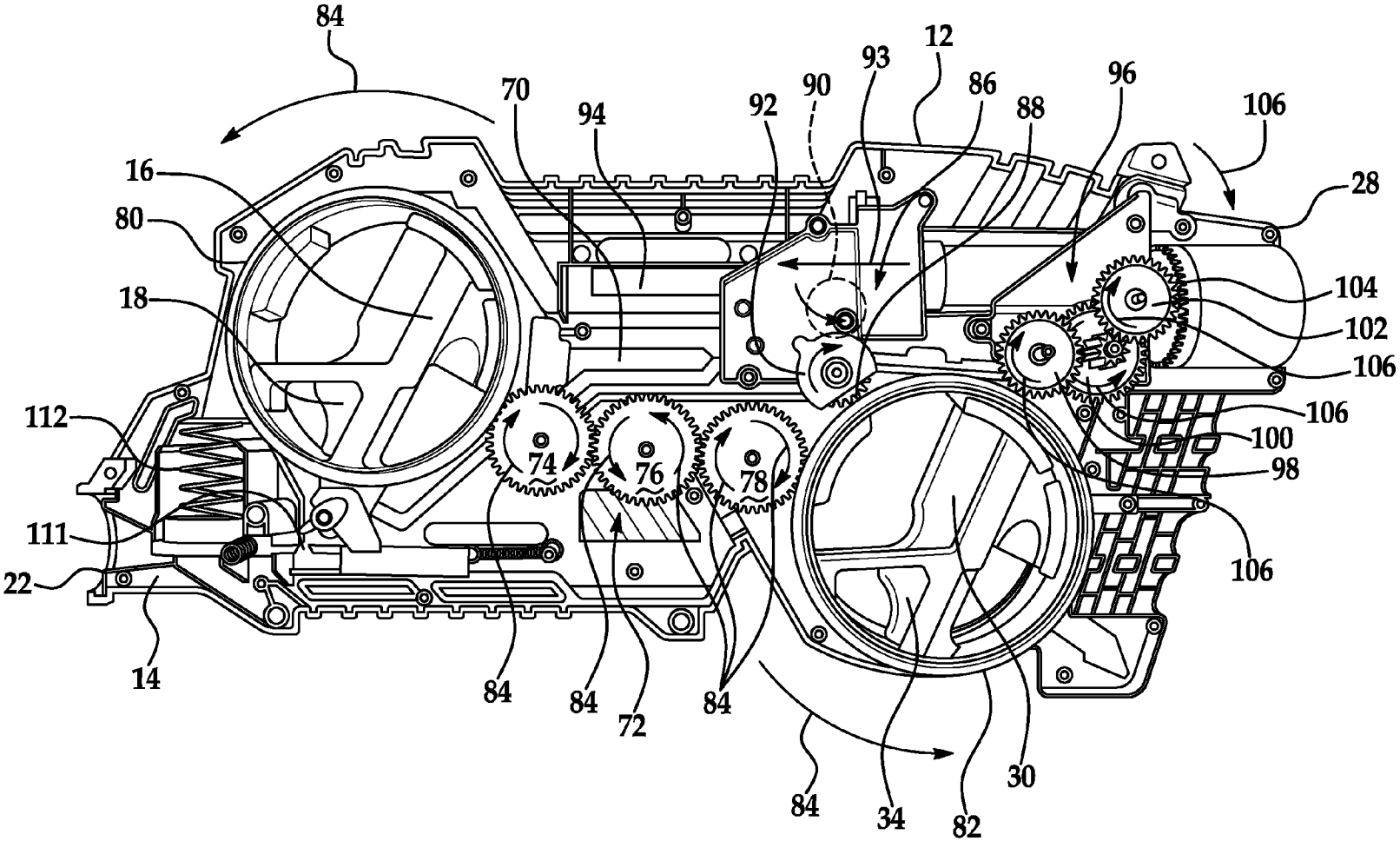
FIGS. 5*a*-5*d* illustrate the internal mechanisms of a toy constructed in accordance with an exemplary embodiment of the present invention.
Figure 5B:
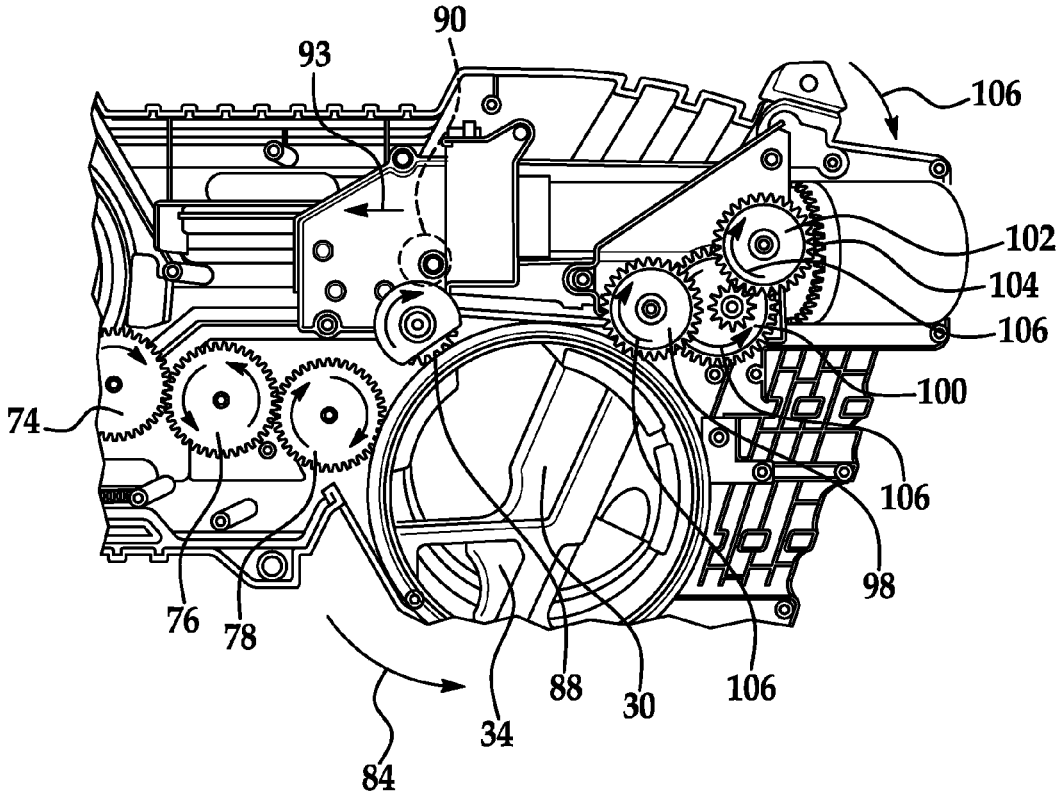
Figure 5C:
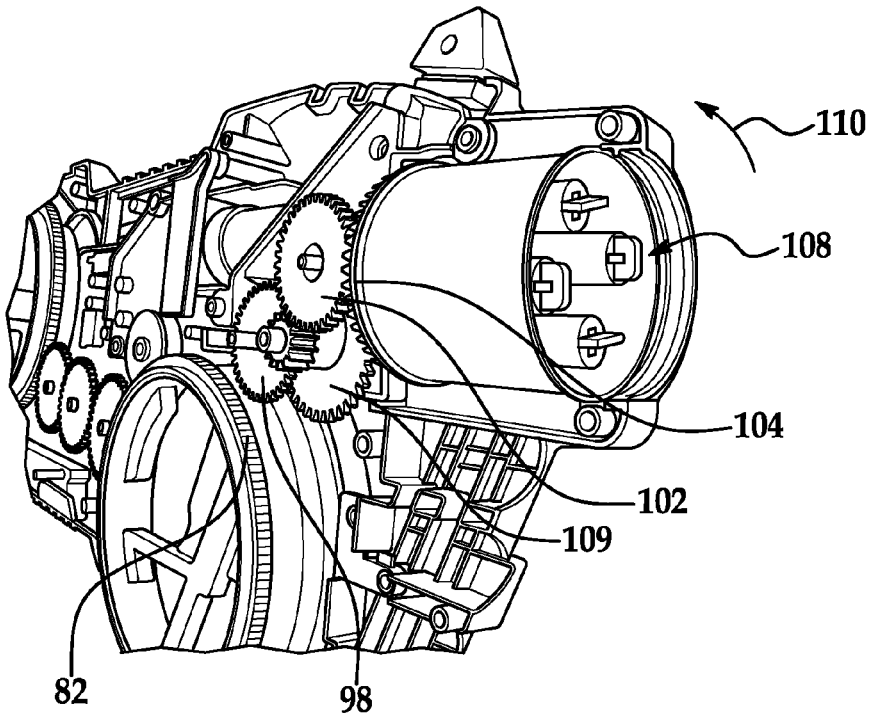
Figure 5D:
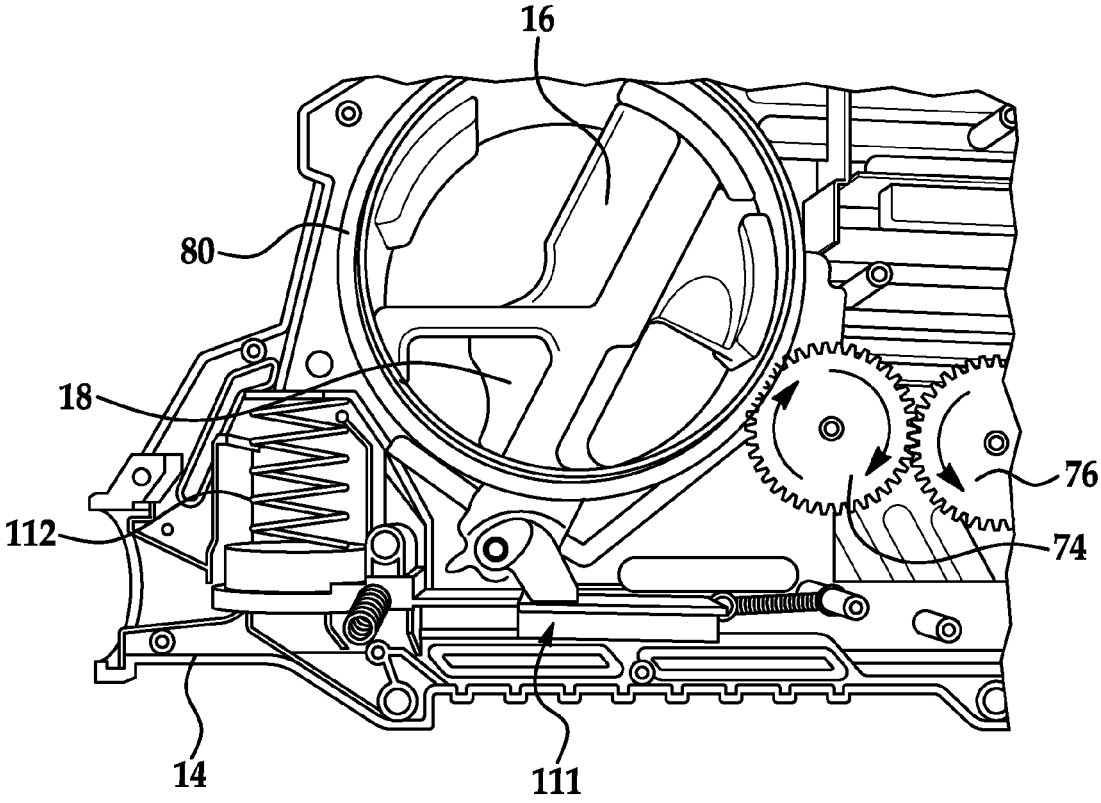

Referring now to FIGS. 5*a*-5*d* and in accordance with one non-limiting alternative exemplary embodiment, a mechanism 70 for transforming the toy from the first orientation to the second orientation is illustrated. It being understood that the toy in FIGS. 5*a*-5*b* is in the first configuration illustrated in FIGS. 1, 2, 3*a* and 4*a* wherein projectiles are capable of being shot from opening 22 at the first end portion. As previously discussed, the first handle portion and the second handle potion are each rotatably received within openings in the housing such that rotation of one handle rotates the other handle through mechanism 70, which includes a gear train 72 comprising a plurality of gears 74, 76 and 78, wherein gear 74 engages a geared or toothed periphery 80 of handle portion 16 as well as gear 76 and gear 78 engages a geared or toothed periphery 82 of handle portion 30 as well as gear 76 such that rotation of handles 16 and 30 effect or cause rotation of the gear train 72 in the directions of arrows 84. Of course, it is understood that rotation may be effected in a direction opposite to arrows 84. However and in one non-limiting embodiment, the triggers and respective handles only rotate in one direction to ensure proper performance of the mechanisms and eliminate the possibility of entanglement of the handles due to the same rotating in opposite directions. Also, gear train 70 helps with rotation of the entire toy from the first orientation to the second orientation such that adding rotation to one handle will rotate the other handle and both handles must be rotated in order to be able to play with the toy and engage the launcher that is pointing away from the user.

In addition and in the embodiment illustrated in FIGS. 5*a*-5*d* when moving the toy from the first configuration illustrated in FIGS. 1, 2, 3*a* and 4*a* to the second configuration illustrated in FIGS. 3*b* and 4*b*, rotation of handle portion 30 and geared outer periphery 82 a first gear train 86 comprising gears 88 and 90 rotates in the direction of arrows 92 such that a plunger for shooting projectiles 37 is compressed against a spring 94 in the direction of arrow 93 to a cocked position and thus actuation of trigger 34 when the toy is in the second configuration will released the cocked plunger and shoot projectiles 37 from the second end of the toy. Accordingly, the manipulation of the toy from the first configuration to the second configuration cocks or activates the plunger for shooting of projectiles 37. In addition, a second gear train 96 is also provided wherein a first gear 98 engages geared outer periphery 82 and a second gear 100 while a third gear 102 engages the second gear 100 and a gear 104 such that moving of the toy from the first configuration illustrated in FIGS. 1, 2, 3*a* and 4*a* to the second configuration illustrated in FIGS. 3*b* and 4*b*, rotation of handle portion 30 and geared outer periphery 82 causes gears 98, 100, 102 and 104 in the direction of arrows 106 which in turn rotates a barrel assembly 108 in the direction of arrow 110 (FIG. 5*c*) such that a projectile is moved into alignment with the plunger being cocked by gear train 86.

In other words, rotation of handle 30 in the direction of arrow 84 actuates gear trains 86 and 96 wherein gear train 86 cocks or activates a plunger mechanism or a second object launcher and gear train 96 rotates a projectile into alignment with the cocked plunger mechanism such that a larger projectile can be shot from the toy when it is moved from the first configuration illustrated in FIGS. 1, 2, 3*a* and 4*a* to the second configuration illustrated in FIGS. 3*b* and 4*b*.

When the toy is moved from the second configuration illustrated in FIGS. 3*b* and 4*b* to the first configuration illustrated in FIGS. 1, 2, 3*a* and 4*a* handle 16 is positioned so that trigger 18 can actuate a mechanism or a first object launcher 111 for launching projectiles from opening 22 in the first end portion 14. In one embodiment and when the toy is in this position actuation of trigger 18 will cause launcher 111 to launch projectiles from opening 22. Also illustrated is a spring biased member to ensure each one of a plurality of disks loaded into chamber 112 are engaged or launched by mechanism 111 when trigger 18 is actuated when the toy is in the first orientation. In addition, the first trigger member is inoperable when the toy is in the second orientation and the second trigger member is inoperable when the toy is in the first orientation.

Although one particular mechanism 70 is illustrated in FIGS. 5*a*-5*d* the same is merely provided as one means for transforming the toy from the first orientation to the second orientation and vice versa and exemplary embodiments of the present invention are not intended to be limited to the specific configurations illustrated herein.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A toy capable of moving between a first orientation and a second orientation, comprising:

a housing having a first end portion with a first handle, and a second end portion with a second handle, wherein at least one of the first and second handles is rotatable within a respective handle opening defined by the housing;

wherein to move the toy from the first orientation to the second orientation, at least one of the first and second handles is rotated by a user within its handle opening, such that the housing is inverted and rotated between the first orientation and the second orientation and wherein the first handle is coupled to the second handle such that rotation of the first handle causes rotation of the second handle.

2. The toy as in claim 1, wherein the housing is rotated at least 180 degrees between its first and second orientation.

3. The toy as in claim 1, where the first handle includes a first trigger member for actuating a first object launcher for launching objects from the first end portion.

4. The toy as in claim 3, wherein the second handle includes a second trigger member for actuation a second object launcher for launching objects from the second end portion.

5. The toy as in claim 4, wherein the first trigger member is inoperable when the toy is in the second orientation and the second trigger member is inoperable when the toy is in the first orientation.

6. The toy as in claim 5, wherein the housing is rotated at least 180 degrees between its first and second orientation.

7. The toy as in claim 1, wherein the second handle includes a second trigger member for actuation of a second object launcher for launching objects from the second end portion.

8. A toy capable of launching a first object and a second object and further capable of moving between a first orientation and a second orientation comprising:

a housing having a first end portion with a first handle adapted to be grasped by a user's first hand, and a second end portion with a second handle adapted to be grasped by a user's second hand, wherein each of the first and second handles are rotatable within a respective handle opening defined by the housing;

wherein to move the toy from the first orientation to the second orientation, the user rotates the handles within their handle opening, such that the housing is rotated and inverted between the first orientation and the second orientation while the handles maintain a similar orientation in the first and second orientations.

9. The toy as in claim 8, wherein the housing is rotated at least 180 degrees between its first and second orientation.

10. The toy as in claim 9, wherein the first handle includes a first trigger member for actuating a first object launcher for launching the first object from the first end portion.

11. The toy as in claim 10, wherein the second handle includes a second trigger member for actuation of a second object launcher for launching the second object from the second end portion.

12. The toy as in claim 11, wherein the first trigger member is inoperable when the toy is in the second orientation and the second trigger member is inoperable when the toy is in the first orientation.

13. The toy as in claim 8, further comprising a gear train operably connected to the first handle and the second handle such that rotation of the first handle rotates the second handle and vice versa.

14. The toy as in claim 8, further comprising a gear train operably connected to the second handle and a second object launcher such that rotation of the second handle activates the second object launcher.

15. A toy capable of launching a first object and a second object and further capable of moving between a first orientation and a second orientation comprising:

a housing having a first end portion with a first handle adapted to be grasped by a user's first hand, and a second end portion with a second handle adapted to be grasped by a user's second hand, wherein each of the first and second handles are rotatable within a respective handle opening defined by the housing;

wherein to move the toy from the first orientation to the second orientation, the user rotates the handles within their handle opening, such that the housing is rotated between the first orientation and the second orientation while the handles maintain a similar orientation in the first and second orientations and wherein the toy further comprises a gear train operably connected to the second handle and a second object launcher such that rotation of the second handle rotates a projectile into alignment with the second object launcher.

16. The toy as in claim 15, further comprising a gear train operably connected to the first handle and the second handle such that rotation of the first handle rotates the second handle and vice versa.

17. The toy as in claim 16, further comprising a gear train operably connected to the second handle and the second object launcher such that rotation of the second handle activates the second object launcher.

18. The toy as in claim 17, wherein the housing is inverted and rotated at least 180 degrees between its first and second orientation.

19. A toy capable of launching a first object and a second object and further capable of moving between a first orientation and a second orientation comprising:

a housing having a first end portion with a first handle adapted to be grasped by a user's first hand, and a second end portion with a second handle adapted to be grasped by a user's second hand, wherein each of the first and second handles are rotatable within a respective handle opening defined by the housing;

wherein to move the toy from the first orientation to the second orientation, the user rotates the handles within their handle opening, such that the housing is rotated between the first orientation and the second orientation while the handles maintain a similar orientation in the first and second orientations, wherein the first handle includes a first trigger member for actuating a first object launcher for launching the first object from the first end portion and the second handle includes a second trigger member for actuation of a second object launcher for launching the second object from the second end portion and wherein the first trigger member is inoperable when the toy is in the second orientation and the second trigger member is inoperable when the toy is in the first orientation.

20. The toy as in claim 13, wherein the first handle includes a first trigger member for actuating a first object launcher for launching the first object from the first end portion and the second handle includes a second trigger member for actuation of a second object launcher for launching the second object from the second end portion and wherein the first trigger member is inoperable when the toy is in the second orientation and the second trigger member is inoperable when the toy is in the first orientation.

21. The toy as in claim 4, wherein objects launched from the first object launcher are different from objects launched from the second object launcher.

22. The toy as in claim 8, wherein the first object is different from the second object.

23. The toy as in claim 15, wherein the first object is different from the second object.

* * * * *